US005921855A

United States Patent [19]

Osterheld et al.

[11] Patent Number: 5,921,855

[45] Date of Patent: Jul. 13, 1999

[54] POLISHING PAD HAVING A GROOVED PATTERN FOR USE IN A CHEMICAL MECHANICAL POLISHING SYSTEM

[75] Inventors: Tom Osterheld, Mountain View; Sen-hou Ko, Cupertino, both of Calif.

[73] Assignee: Applied Materials, Inc., Santa Clara, Calif.

[21] Appl. No.: 08/856,948

[22] Filed: May 15, 1997

[51] Int. Cl.[6] ..... B24D 11/00

[52] U.S. Cl. ..... 451/527; 451/550

[58] Field of Search ..... 451/59, 527, 533, 451/539, 548, 550

[56] References Cited

U.S. PATENT DOCUMENTS 5,020,283 6/1991 Tuttle .
5,131,190 7/1992 Gougouyan ..... 451/550 X
5,177,908 1/1993 Tuttle .
5,190,568 3/1993 Tselesin ..... 451/527 X
5,216,843 6/1993 Breivogel et al. ..... 451/550 X
5,297,364 3/1994 Tuttle .
5,329,734 7/1994 Yu .
5,394,655 3/1995 Allen et al. .
5,421,769 6/1995 Schultz et al. .
5,489,233 2/1996 Cook et al. .
5,578,362 11/1996 Reinhardt et al. ..... 451/527 X
5,645,469 7/1997 Burke et al. ..... 451/527 X
5,650,039 7/1997 Talieh .

*Primary Examiner*—Timothy V. Eley
*Attorney, Agent, or Firm*—Fish & Richardson

[57] ABSTRACT

A polishing pad for a chemical mechanical polishing apparatus. The polishing pad includes a plurality of concentric circular grooves uniformly spaced over the polishing surface of the polishing pad.

15 Claims, 5 Drawing Sheets

POLISHING PAD HAVING A GROOVED PATTERN FOR USE IN A CHEMICAL MECHANICAL POLISHING SYSTEM

BACKGROUND OF THE INVENTION

The present invention relates generally to chemical mechanical polishing of substrates, and more particularly to a polishing pad having a grooved pattern for a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. If the outer surface of the substrate is non-planar, then a photoresist layer placed thereon is also non-planar. A photoresist layer is typically patterned by a photolithographic apparatus that focuses a light image onto the photoresist. If the outer surface of the substrate is sufficiently non-planar, the maximum height difference between the peaks and valleys of the outer surface may exceed the depth of focus of the imaging apparatus. Then it will be impossible to properly focus the light image onto the entire outer surface. Therefore, there is a need to periodically planarize the substrate surface to provide a flat surface for photolithography.

Chemical mechanical polishing (CMP) is one accepted method of planarization. This method typically requires that the substrate be mounted on a carrier or polishing head. The exposed surface of the substrate is then placed against a rotating polishing pad. The carrier head provides a controllable load, i.e., pressure, on the substrate to push it against the polishing pad. In addition, the carrier head may rotate to provide additional motion between the substrate and polishing surface.

A polishing slurry, including an abrasive and at least one chemically-reactive agent, may be supplied to the polishing pad to provide an abrasive chemical solution at the interface between the pad and the substrate. CMP is a fairly complex process, and it differs from simple wet sanding. In a CMP process, the reactive agent in the slurry reacts with the outer surface of the substrate to form reactive sites. The interaction of the polishing pad and abrasive particles with the reactive sites on the substrate results in polishing.

An effective CMP process has a high polishing rate and generates a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. The polishing rate sets the time needed to polish a layer. Because inadequate flatness and finish can create defective substrates, the selection of a polishing pad and slurry combination is usually dictated by the required finish and flatness. Given these constraints, the polishing time needed to achieve the required finish and flatness sets the maximum throughput of the CMP apparatus.

One problem in CMP relates to slurry distribution. As was indicated above, the CMP process is fairly complex, requiring the interaction of the polishing pad, abrasive particles and reactive agent with the substrate to obtain the desired polishing results. Accordingly, ineffective distribution of the slurry across the surface of the polishing pad provide less than optimal polishing results. Polishing pads have been used which include perforations about the pad. The perforations, when filled, distribute slurry in their respective local region as the polishing pad is compressed. This method of slurry distribution has limited effectiveness because each perforation in effect acts independently. Thus, some of the perforations may have too little slurry, while others may have too much slurry. Furthermore, there is no way to directly channel the excess slurry to where it is needed.

Another problem in CMP is "glazing" of the polishing pad. Glazing occurs when the polishing pad is heated and compressed in regions where the substrate is pressed against it. The peaks of the polishing pad are pressed down and the pits of the polishing pad are filled up, so the surface of the polishing pad becomes smoother and less abrasive. As a result, the polishing time required to polish a substrate increases. Therefore, the polishing pad surface must be periodically returned to an abrasive condition, or "conditioned", to maintain a high throughput.

In addition, during the conditioning process, waste materials associated with abrading the surface of the pad may fill or clog the perforations in the polishing pad. Filled or clogged perforations can not hold slurry, thereby reducing the effectiveness of the polishing process.

An additional problem associated with filled or clogged perforations relates to the separation of the polishing pad from the substrate after polishing has been completed. The polishing process produces a high degree of surface tension between the polishing pad and the substrate. The perforations decrease the surface tension by reducing the contact area between the polishing pad and the substrate. However, as the perforations become filled or clogged with waste material, the surface tension increases, making it more difficult to separate the polishing pad and the substrate. As such, the substrate is more likely to be damaged during the separation process.

Yet another problem in CMP is referred to as the "planarizing effect". Ideally, a polishing pad only polishes peaks in the topography of the substrate. After a predefined period of polishing, the areas of these peaks will eventually be level with the valleys, resulting in a planar surface. However, if a substrate is subjected to the "planarizing effect", the peaks and valleys will be polished simultaneously. The "planarizing effect" results from the compressible nature of the polishing pad in response to point loading. In particular, if the polishing pad is too flexible, it will deform and contact a large surface area of the substrate.

Accordingly, it would be useful to provide a CMP system which reduces or solves some, if not all, of these problems.

SUMMARY OF THE INVENTION

In one aspect, the present invention is directed to a polishing pad for polishing a substrate in a chemical mechanical polishing system. The polishing pad has a polishing surface having a plurality of substantially circular grooves. The grooves having a depth of at least about 0.02 inches, a width of at least about 0.015 inches, and a pitch of at least about 0.09 inches.

Implementations of the invention include the following. The grooves may be concentrically arranged and uniformly spaced over the polishing surface. The grooves may have a depth between 0.02 and 0.05 inches, such as 0.03 inches, a width between about 0.015 and 0.04 inches, such as 0.20 inches, and a pitch between about 0.09 and 0.24 inches, such as 0.12 inches. The polishing pad may comprise an upper layer and a lower layer with the grooves being formed in the upper layer. The upper layer may have a thickness between about 0.06 and 0.12 inches, and the distance between a bottom portion of the grooves and the lower layer may be about 0.04 inches.

In another aspect, a polishing surface of the polishing pad has a spiral groove having a depth of at least about 0.02 inches, a width of at least about 0.015 inches, and a pitch of at least about 0.09 inches.

In another aspect, a polishing surface of the polishing pad has a plurality of grooves separated by partitions, the grooves having a depth of at least about 0.02 inches and a width of at least about 0.015 inches and the partitions having a width of at least about 0.075 inches. The ratio of the width of the grooves to the partitions is between about 0.10 and 0.25.

Advantages of the invention include the following. The grooves of the polishing pad provide an effective way to distribute slurry across the pad. The grooves are sufficiently wide that waste material produced by the conditioning process can be flushed from the grooves. The polishing pad is sufficiently rigid to avoid the "planarizing effect". The polishing pad's relatively deep grooves also improve the pad lifetime.

Other features and advantages will be apparent from the following description, including the drawings and claims.

DETAILED DESCRIPTION OF THE PREFERRED EMBODIMENT(S)

Figure 1:
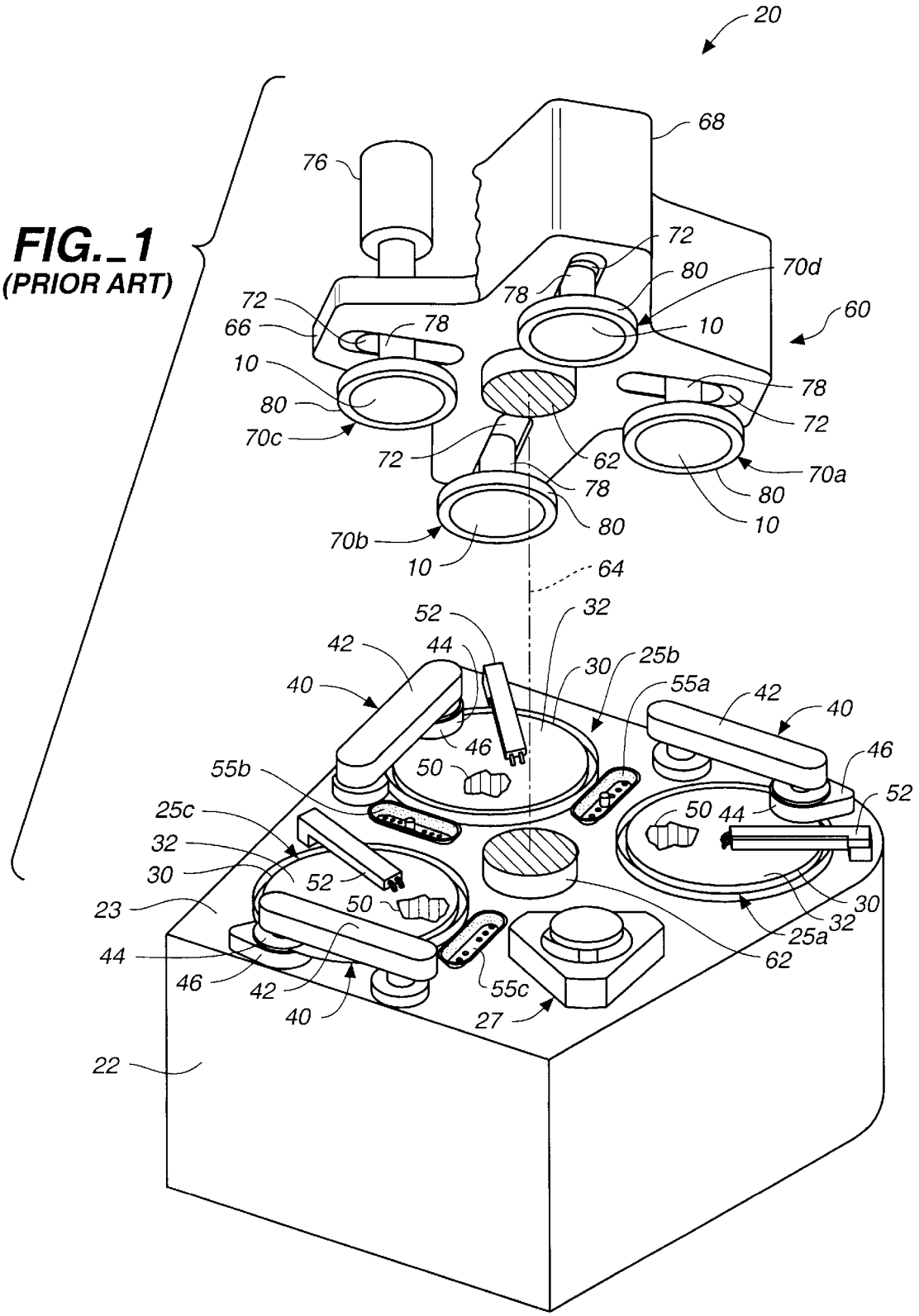
FIG. 1 (PRIOR ART)
FIG. 1 is a schematic exploded perspective view of a chemical mechanical polishing apparatus.

Referring to FIG. 1, one or more substrates 10 will be polished by a chemical mechanical polishing apparatus 20. A complete description of polishing apparatus 20 may be found in U.S. patent application Ser. No. 08/549,336, entitled RADIALLY OSCILLATING CAROUSEL PROCESSING SYSTEM FOR CHEMICAL MECHANICAL POLISHING, filed Oct. 27, 1995 by Ilya Perlov, et al., and assigned to the assignee of the present invention, the entire disclosure of which is incorporated herein by reference. According to the present invention, polishing apparatus 20 includes a lower machine base 22 with a table top 23 mounted thereon and a removable outer cover (not shown). Table top 23 supports a series of polishing stations 25*a*, 25*b* and 25*c*, and a transfer station 27. Transfer station 27 forms a generally square arrangement with the three polishing stations 25*a*, 25*b* and 25*c*. Transfer station 27 serves multiple functions, including receiving individual substrates 10 from a loading apparatus (not shown), washing the substrates, loading the substrates into carrier heads (to be described below), receiving the substrates from the carrier heads, washing the substrates again, and finally, transferring the substrates back to the loading apparatus.

Each polishing station includes a rotatable platen 30 on which is placed a polishing pad 32. If substrate 10 is an eight inch (200 millimeter) diameter disk, then platen 30 and polishing pad 32 will be about twenty inches in diameter. Platen 30 may be a rotatable aluminum or stainless steel plate connected to a platen drive motor (not shown). For most polishing processes, the platen drive motor rotates platen 30 at thirty to two hundred revolutions per minute, although lower or higher rotational speeds may be used.

Each polishing station 25*a*–25*c* may further include an associated pad conditioner apparatus 40. Each pad conditioner apparatus 40 has a rotatable arm 42 holding an independently-rotating conditioner head 44 and an associated washing basin 46. The conditioner apparatus maintains the condition of the polishing pad so it will effectively polish any substrate pressed against it while it is rotating.

A slurry 50 containing a reactive agent (e.g., deionized water for oxide polishing), abrasive particles (e.g., silicon dioxide for oxide polishing) and a chemically-reactive catalyzer (e.g., potassium hydroxide for oxide polishing) is supplied to the surface of polishing pad 32 by a combined slurry/rinse arm 52. The slurry/rinse arm may include two or more slurry supply tubes to provide slurry to the surface of the polishing pad. Sufficient slurry is provided to cover and wet the entire polishing pad 32. Slurry/rinse arm 52 also includes several spray nozzles (not shown) which provide a high-pressure rinse of polishing pad 32 at the end of each polishing and conditioning cycle.

Two or more intermediate washing stations 55*a* and 55*b* may be positioned between neighboring polishing stations 25*a*, 25*b* and 25*c*. The washing stations rinse the substrates as they pass from one polishing station to another.

A rotatable multi-head carousel 60 is positioned above lower machine base 22. Carousel 60 is supported by a center post 62 and is rotated thereon about a carousel axis 64 by a carousel motor assembly located within base 22. Center post 62 supports a carousel support plate 66 and a cover 68. Carousel 60 includes four carrier head systems 70*a*, 70*b*, 70*c*, and 70*d*. Three of the carrier head systems receive and hold substrates, and polish them by pressing them against polishing pads 32 on platens 30 of polishing stations 25*a*–25*c*. One of the carrier head systems receives a substrate from and delivers a substrate to transfer station 27.

The four carrier head systems 70*a*–70*d* are mounted on carousel support plate 66 at equal angular intervals about carousel axis 64. Center post 62 allows the carousel motor to rotate carousel support plate 66 and to orbit carrier head systems 70*a*–70*d* and the substrates attached thereto about carousel axis 64.

Each carrier head system 70*a*–70*d* includes a carrier or carrier head 80. Each carrier head 80 independently rotates about its own axis. A carrier drive shaft 74 connects a carrier head rotation motor 76 (shown by the removal of one quarter of cover 68) to carrier head 80. There is one carrier drive shaft and motor for each head. In addition, each carrier head 80 independently laterally oscillates in a radial slot 72 formed in carousel support plate 66. A slider (not shown) supports each drive shaft 74 in radial slot 72. A radial drive motor (not shown) may move the slider to laterally oscillate the carrier head.

The carrier head 80 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations.

Figure 2:
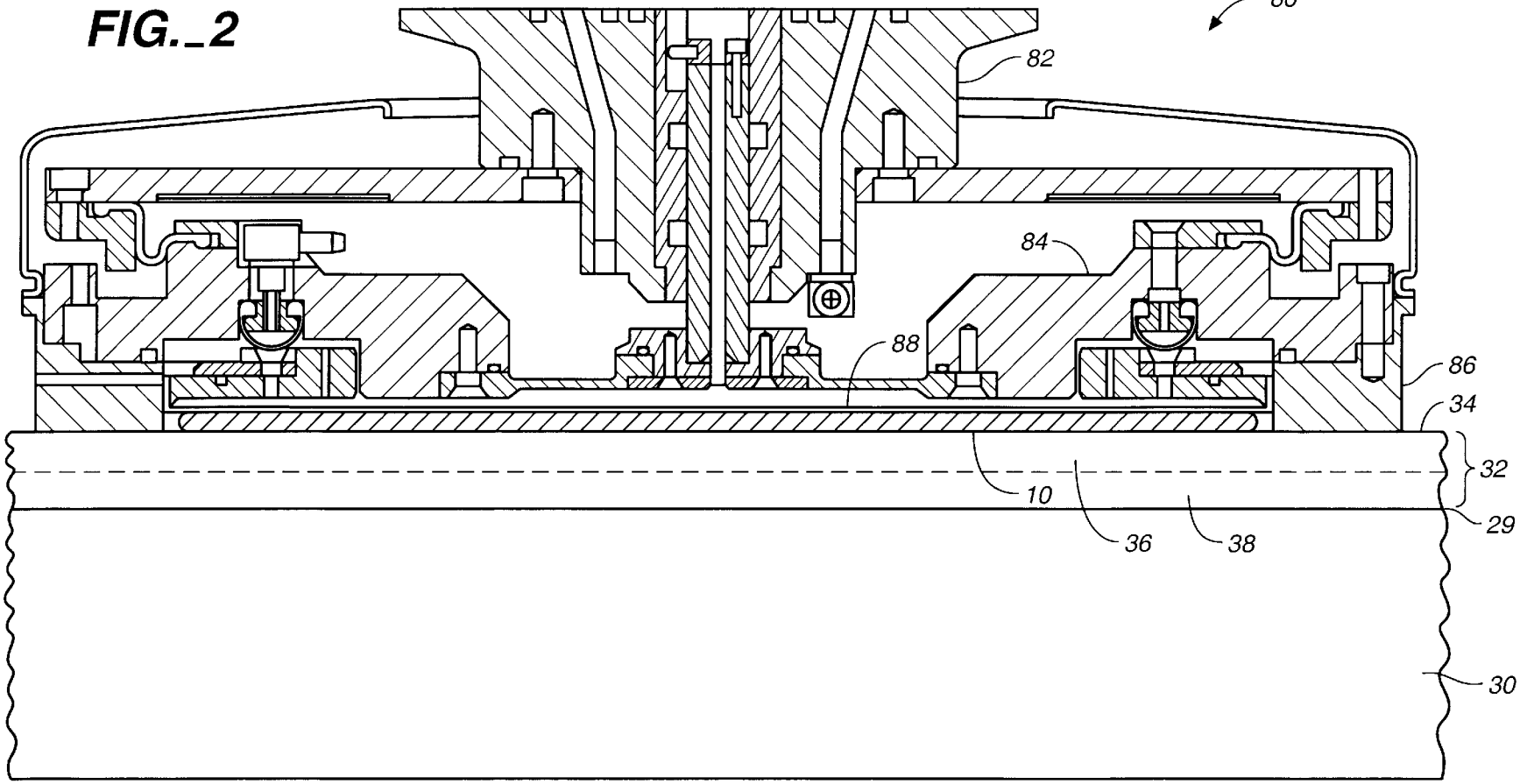
FIG. 2 is a schematic cross-sectional view of a carrier head and a polishing pad.

Referring to FIG. 2, each carrier head 80 includes a housing assembly 82, a base assembly 84 and a retaining ring assembly 86. A loading mechanism may connect base assembly 84 to housing assembly 82. The base assembly 84 may include a flexible membrane 88 which provides a substrate receiving surface for the carrier head. A description of carrier head 80 may be found in U.S. patent application Ser. No. 08/745,679, entitled A CARRIER HEAD WITH A FLEXIBLE MEMBRANE FOR A CHEMICAL MECHANICAL POLISHING SYSTEM, filed Nov. 8, 1996, by Steven M. Zuniga et al., assigned to the assignee of the present invention, the entire disclosure of which is incorporated herein by reference.

Figure 3:
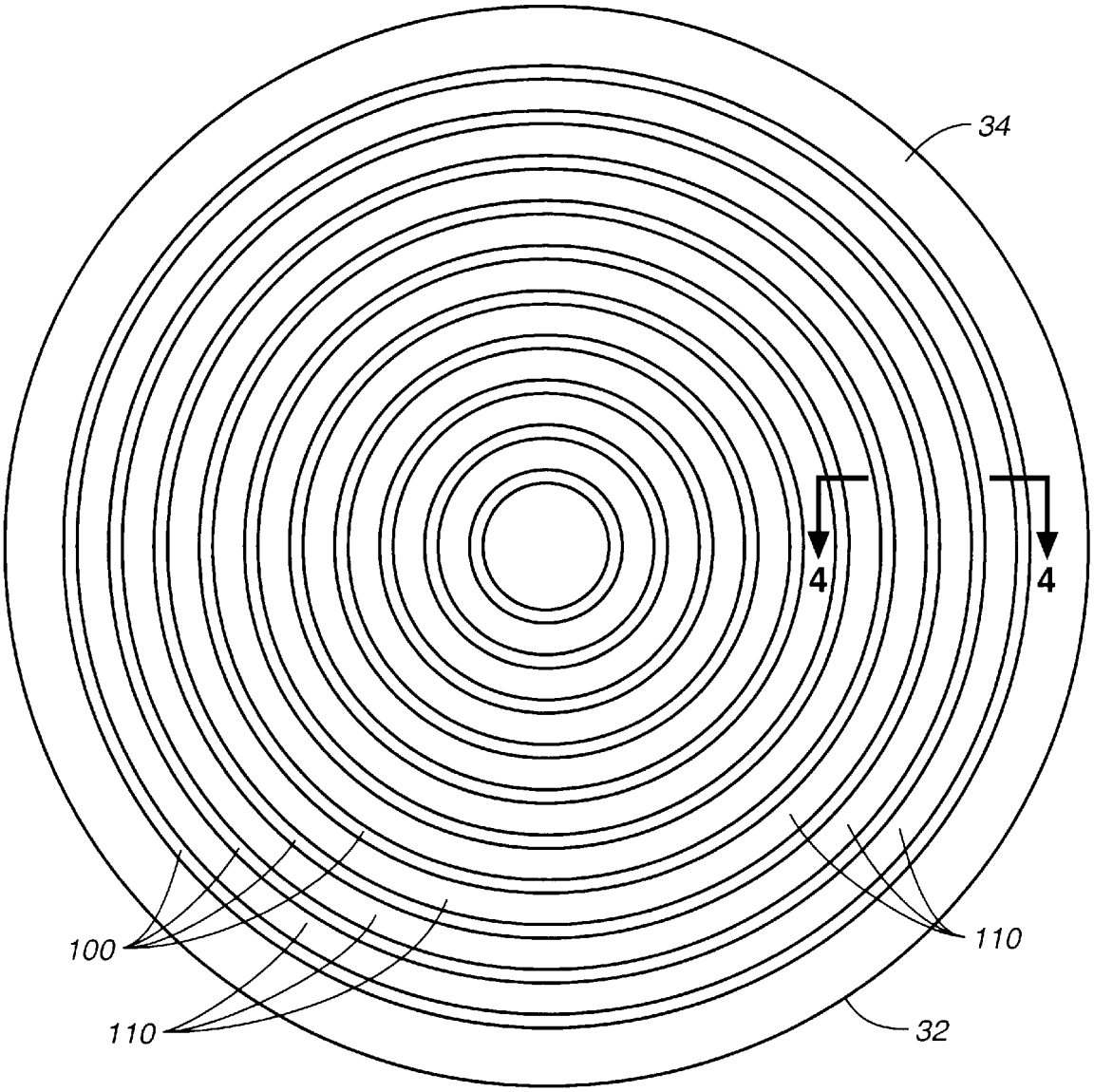
FIG. 3 is a schematic top view of a polishing pad according to the present invention.
Figure 4:
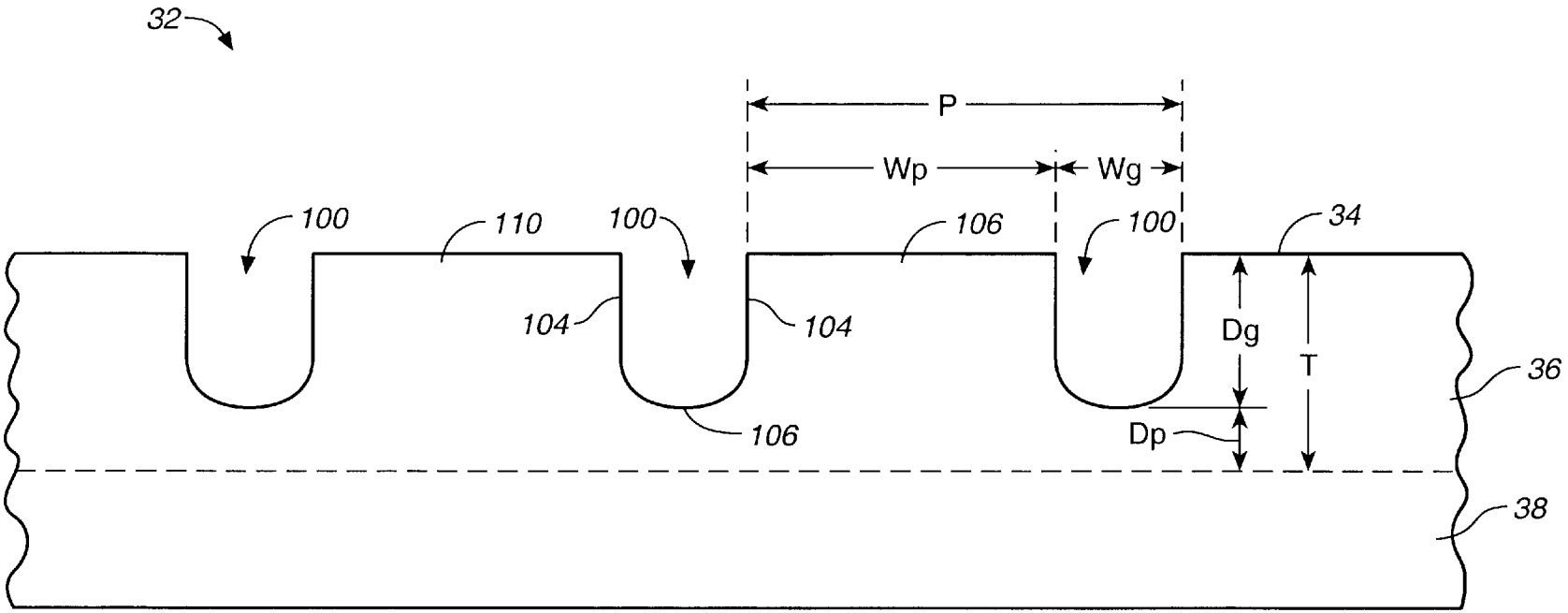
FIG. 4 is a schematic cross-sectional view of the polishing pad of FIG. 3 along line 4—4.

As shown in FIGS. 2–4, polishing pad 32 may comprise a hard composite material having a roughened polishing surface 34. Polishing pad 32 may have an upper layer 36 and a lower layer 38. Lower layer 38 may be attached to platen 30 by a pressure-sensitive adhesive layer 39. Upper layer 36 may be harder than lower layer 38. Upper layer 36 may be composed of polyurethane or polyurethane mixed with a filler. Lower layer 38 may be composed of compressed felt fibers leached with urethane. A two-layer polishing pad, with the upper layer composed of IC-1000 and the lower layer composed of SUBA-4, is available from Rodel, Inc., of Newark, Del. (IC-1000 and SUBA-4 are product names of Rodel, Inc.).

Referring to FIGS. 3 and 4, a plurality of concentric circular grooves 100 are disposed in polishing surface 34 of polishing pad 32. Advantageously, these grooves are uniformly spaced with a pitch P. The pitch P is the radial distance between adjacent grooves. Between each groove is an annular partition 110 having a width Wp. Each groove 100 includes walls 104 which terminate in a substantially U-shaped base portion 106. Each groove may have a depth Dg and a width Wg.

The walls 104 may be generally perpendicular and terminate at U-shaped base 106. Each polishing cycle results in wear of polishing pad 32, generally in the form of thinning of the polishing pad as polishing surface 34 is worn down. The width Wg of a groove with substantially perpendicular walls 104 does not change as the polishing pad is worn. Thus, the generally perpendicular walls ensure that the polishing pad has a substantially uniform surface area over its operating lifetime.

The polishing pad of the present invention include wide and deep grooves in comparison to those used in the past. The grooves 100 have a minimum width Wg of about 0.015 inches. Each groove 100 may have a width Wg between about 0.015 and 0.04 inches. Specifically, the grooves may have a width Wg of approximately 0.020 inches. Each partition 110 may have a width Wp between about 0.075 and 0.20 inches. Specifically, the partitions may have a width Wp of approximately 0.10 inches. Accordingly, the pitch P between the grooves may be between about 0.09 and 0.24 inches. Specifically, the pitch may be approximately 0.12 inches.

The ratio of groove width Wg to partition width Wp may be selected to be between about 0.10 and 0.25. The ratio may be approximately 0.2. If the grooves are too wide, the polishing pad will be too flexible, and the "planarizing effect" will occur. On the other hand, if the grooves are too narrow, it becomes difficult to remove waste material from the grooves. Similarly, if the pitch is too small, the grooves will be too close together and the polishing pad will be too flexible. On the other hand, if the pitch is too large, slurry will not be evenly transported to the entire surface of the substrate.

The grooves 100 also have a depth Dg of at least about 0.02 inches. The depth Dg may be between about 0.02 and 0.05 inches. Specifically, the depth Dg of the grooves may be approximately 0.03 inches. Upper layer 36 may have a thickness T between about 0.06 and 0.12 inches. As such, the thickness T may be about 0.07 inches. The thickness T should be selected so that the distance Dp between the bottom of base portion 106 and lower layer 38 is between about 0.035 and 0.085 inches. Specifically, the distance Dp may be about 0.04 inches. If the distance Dp is too small, the polishing pad will be too flexible. On the other hand, if the distance Dp is too large, the polishing pad will be thick and, consequently, more expensive.

Referring to FIG. 3, grooves 100 form a pattern defining a plurality of annular islands or projections. The surface area presented by these islands for polishing is between about 10% and 25% of the total surface area of polishing pad 32. As a result, the surface tension between the substrate and the polishing pad is reduced, facilitating separation of the polishing pad from the substrate at the completion of a polishing cycle.

Figure 5:
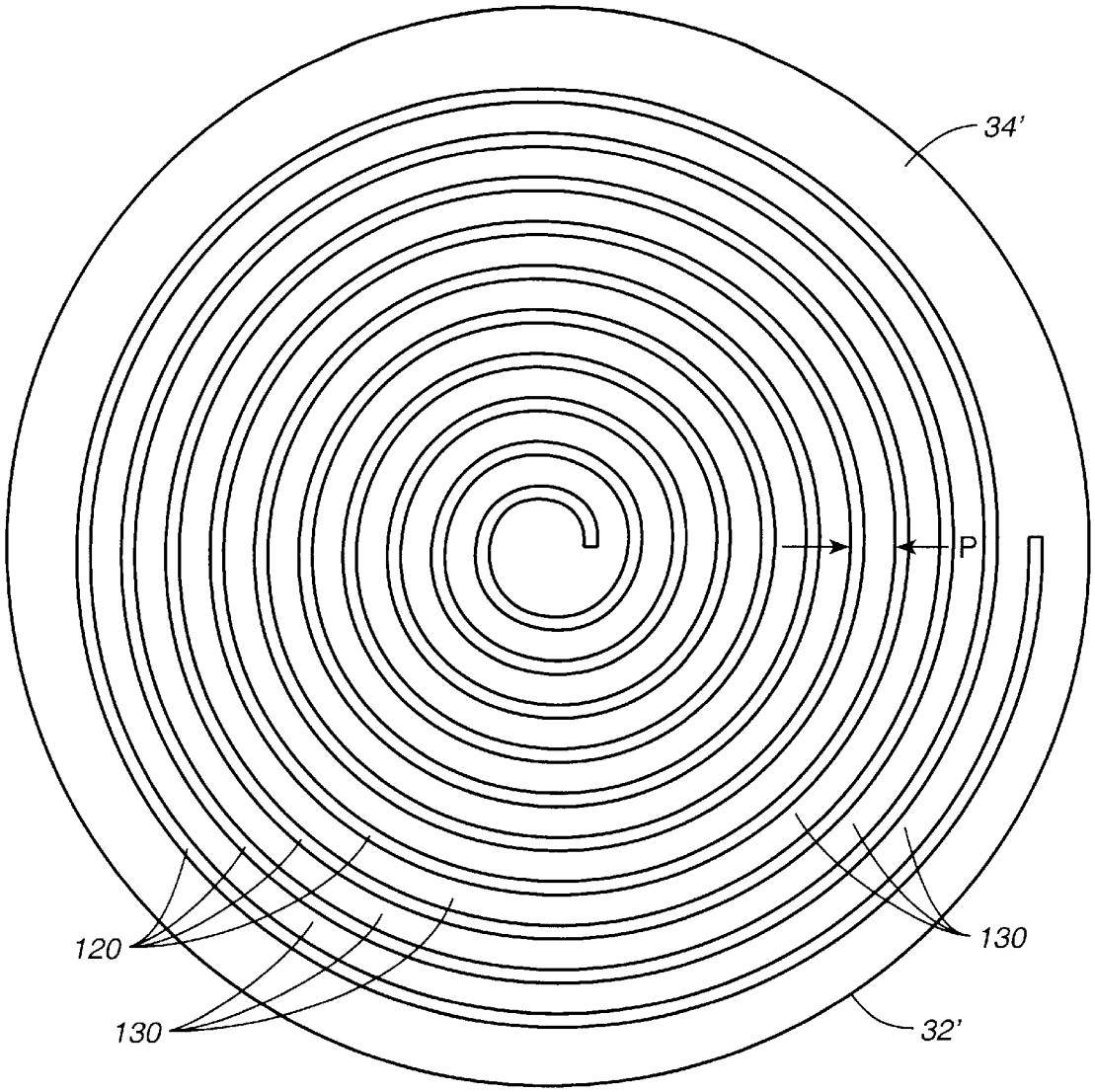
FIG. 5 is a schematic top view of a polishing pad using a spiral groove.

Referring to FIG. 5, in another embodiment, a spiral groove 120 is disposed in polishing surface 34' of polishing pad 32'. Advantageously, the groove is uniformly spaced with a pitch P. A spiral partition 130 separates the rings of the spiral. Spiral groove 120 and spiral partition 130 may have the same dimensions as circular groove 100 and circular partition 110. That is, spiral groove 120 may have depth of at least about 0.02 inches, a width of at least about 0.015 inches, and a pitch of at least about 0.09 inches. Specifically, spiral groove 120 may have a depth between 0.02 and 0.05 inches, such as 0.03 inches, a width between about 0.015 and 0.40 inches, such as 0.20 inches, and a pitch P between about 0.09 and 0.24 inches, such as 0.12 inches.

The grooves provide air channels which reduce any vacuum build-up between the polishing pad and the substrate. However, as the surface area available for polishing decreases, an accompanying increase in the polishing time may be required to achieve the same polishing results.

The grooves may be formed in polishing surface 34 by cutting or milling. Specifically, a saw blade on a mill may be used to cut grooves in polishing surface 34. Alternatively, grooves may be formed by embossing or pressing polishing surface 34 with a hydraulic or pneumatic press. The relatively simple groove pattern avoids expensive machining.

As was described above, slurry/rinse arm 52 provides slurry 50 to polishing surface 34. The continuous channels about the polishing pad provided by the grooves facilitate the migration of slurry 50 around the polishing pad. Thus, excess slurry 50 in any region of polishing pad 32 may be transferred to another region by the groove structure, providing more uniform coverage of slurry 50 over polishing surface 34. Accordingly, slurry distribution performance is improved and any variations in the polishing rate attributable to poor slurry distribution will be reduced.

In addition, the grooves reduce the possibility that waste materials generated during the polishing and conditioning cycles may become trapped and interfere with slurry distribution. The grooves facilitate the migration of waste materials away from the polishing pad surface (i.e., uppermost surface of partitions 110 or 130), reducing the possibility of clogging. The grooves will collect waste during the polishing and conditioning processes, reducing the amount of waste which will remain on the polishing pad surface. The width of the grooves permits a spray rinse from slurry/rinse arm 52 to effectively flush the waste materials from the grooves.

The depth of the grooves improves polishing pad lifetime. As discussed above, the conditioning process abrades and removes material from the surface of the polishing pad, thereby reducing the depth of the grooves. Consequently, the lifetime of the pad may be increased by increasing the depth of the grooves.

The invention is not limited to the embodiment depicted and described. Rather, the scope of the invention is defined by the appended claims.

What is claimed is:

1. A polishing pad for polishing a substrate in a chemical mechanical polishing system, comprising:

a polishing surface having a plurality of substantially circular grooves, the grooves having a depth of at least about 0.02 inches, a width of at least about 0.015 inches, and a pitch of at least about 0.09 inches.

2. The polishing pad of claim 1 wherein the grooves are concentrically arranged.

3. The polishing pad of claim 1 wherein the grooves are uniformly spaced over the polishing surface.

4. The polishing pad of claim 1 wherein the grooves have a depth between about 0.02 and 0.05 inches.

5. The polishing pad of claim 4 wherein the grooves have a depth of approximately 0.03 inches.

6. The polishing pad of claim 1 wherein the grooves have a width between about 0.015 and 0.04 inches.

7. The polishing pad of claim 6 wherein the grooves have a width of approximately 0.02 inches.

8. The polishing pad of claim 1 wherein the grooves have a pitch between about 0.09 and 0.24 inches.

9. The polishing pad of claim 8 wherein the grooves have a pitch of approximately 0.12 inches.

10. The polishing pad of claim 1 wherein the polishing pad further comprises an upper layer and a lower layer, the grooves being formed in the upper layer.

11. The polishing pad of claim 10 wherein the upper layer has a thickness between about 0.06 and 0.12 inches.

12. The polishing pad of claim 11 wherein the distance between a bottom portion of the grooves and the lower layer is about 0.04 inches.

13. A polishing pad for polishing a substrate in a chemical mechanical polishing system, comprising:

a polishing surface having a plurality of substantially circular grooves, the grooves having a depth of approximately 0.03 inches, a width of approximately 0.02 inches, and a pitch of approximately 0.12 inches.

14. A polishing pad for polishing a substrate in a chemical mechanical polishing system, comprising:

a polishing surface having a spiral groove having a depth of at least about 0.02 inches, a width of at least about 0.015 inches, and a pitch of at least about 0.09 inches.

15. A polishing pad for polishing a substrate in a chemical mechanical polishing system, comprising:

a polishing surface having a plurality of grooves separated by partitions, the grooves having a depth of at least about 0.02 inches and a width of at least about 0.015 inches and the partitions having a width of at least about 0.075 inches, wherein the ratio of the width of the grooves to the partitions is between about 0.10 and 0.25.

* * * * *

US005921855C1

(12) EX PARTE REEXAMINATION CERTIFICATE (9657th)

United States Patent
Osterheld et al.

(10) Number: US 5,921,855 C1
(45) Certificate Issued: May 16, 2013

(54) POLISHING PAD HAVING A GROOVED PATTERN FOR USE IN A CHEMICAL MECHANICAL POLISHING SYSTEM

(75) Inventors: Tom Osterheld, Mountain View, CA (US); Sen-hou Ko, Cupertino, CA (US)

(73) Assignee: Applied Materials, Inc., Santa Clara, CA (US)

Reexamination Request:
No. 90/010,106, Mar. 12, 2008

Reexamination Certificate for:

| | |
|---|---|
| Patent No.: | **5,921,855** |
| Issued: | **Jul. 13, 1999** |
| Appl. No.: | **08/856,948** |
| Filed: | **May 15, 1997** |

(51) Int. Cl.

| | |
|---|---|
| ***B24B 37/04*** | (2006.01) |
| ***B24D 13/14*** | (2006.01) |
| ***B24D 13/00*** | (2006.01) |

(52) U.S. Cl.
USPC ..... 451/527; 451/550

(58) Field of Classification Search
None
See application file for complete search history.

(56) References Cited

To view the complete listing of prior art documents cited during the proceeding for Reexamination Control Number 90/010,106, please refer to the USPTO's public Patent Application Information Retrieval (PAIR) system under the Display References tab.

*Primary Examiner* — Peter C. English

(57) ABSTRACT

A polishing pad for a chemical mechanical polishing apparatus. The polishing pad includes a plurality of concentric circular grooves uniformly spaced over the polishing surface of the polishing pad.

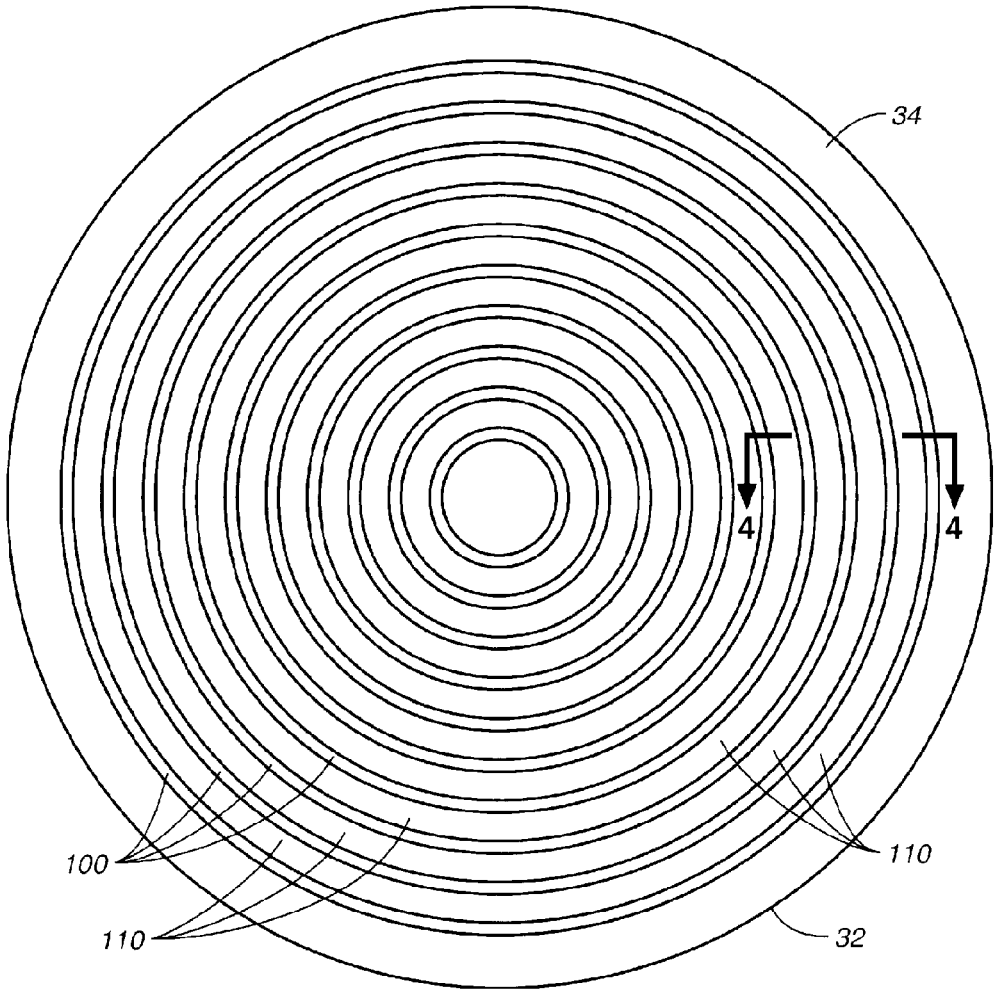

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-15 are cancelled.

* * * * *